US007148868B2

(12) United States Patent
Lee

(10) Patent No.: US 7,148,868 B2
(45) Date of Patent: Dec. 12, 2006

(54) LIQUID CRYSTAL DISPLAY

(75) Inventor: Seung-Woo Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 471 days.

(21) Appl. No.: 10/392,661

(22) Filed: Mar. 20, 2003

(65) Prior Publication Data

US 2003/0179170 A1 Sep. 25, 2003

(30) Foreign Application Priority Data

Mar. 21, 2002 (KR) ..... 10-2002-0015245

(51) Int. Cl.
*G09G 3/36* (2006.01)
*G09G 5/00* (2006.01)
*G09G 5/02* (2006.01)

(52) U.S. Cl. ..... 345/87; 345/204; 345/501; 345/601; 345/605; 345/643; 345/692

(58) Field of Classification Search ..... 345/87
See application file for complete search history.

(56) References Cited

U.S. PATENT DOCUMENTS 4,921,334 A * 5/1990 Akodes ..... 345/89
5,898,414 A * 4/1999 Awamoto et al. ..... 345/55
6,084,561 A * 7/2000 Kudo et al. ..... 345/89
6,329,980 B1 * 12/2001 Uehara et al. ..... 345/204
6,501,451 B1 * 12/2002 Sakashita ..... 345/87
6,771,242 B1 * 8/2004 Ham ..... 345/89
6,825,821 B1 * 11/2004 Oda et al. ..... 345/87
2003/0128176 A1 * 7/2003 Ham ..... 345/87

* cited by examiner

*Primary Examiner*—Sumati Lefkowitz
*Assistant Examiner*—Alexander S. Beck
(74) *Attorney, Agent, or Firm*—Cantor Colburn LLP

(57) ABSTRACT

A liquid crystal display is provided, which includes: a liquid crystal panel assembly including a plurality of pixels connected to a plurality of gate lines and a plurality of data lines; a signal controller for processing image data, the signal controller including a dynamic capacitance capture ("DCC") block for modifying image data assigned to the pixels by selectively performing DCC on the image data based on the difference between the image data of a current frame ("current data") and the image data of a previous frame ("previous data"); a gate driver for sequentially applying a gate-on voltage to the gate lines of the liquid crystal panel assembly; and a data driver selecting data voltages among a plurality of gray voltages in response to the modified image data from the signal controller and applies the data voltages to the data lines of the liquid crystal panel assembly.

18 Claims, 5 Drawing Sheets

| | 0(0) | 8(1) | 16(2) | 24(3) | 32(4) | 40(5) |
|---|---|---|---|---|---|---|
| 0 (0) | 0 | 0 | 0 | 0 | 0 | 0 |
| 8 (1) | 16 | 8 | 8 | 8 | 8 | 0 |
| 16 (2) | 32 | 24 | 16 | 16 | 8 | 8 |
| 24 (3) | 40 | 32 | 32 | 24 | 24 | 16 |
| 32 (4) | 48 | 48 | 40 | 40 | 32 | 24 |
| 40 (5) | 72 | 64 | 56 | 56 | 48 | 40 |
| 48 (6) | 88 | 80 | 72 | 72 | 64 | 56 |

LIQUID CRYSTAL DISPLAY

BACKGROUND OF THE INVENTION (a) Field of the Invention

The present invention relates to a liquid crystal display, and in particular, to a liquid crystal display with color characteristic compensation and response time compensation and a driving method thereof.

(b) Description of Related Art

Flat panel displays such as liquid crystal displays (LCDs) have been developed and substituted for cathode ray tubes (CRTs) since they are suitable for recent personal computers and televisions, which become lighter and thinner.

An LCD representing the flat panel displays includes a liquid crystal panel assembly including two panels provided with two kinds of field generating electrodes such as pixel electrodes and a common electrode and a liquid crystal layer with dielectric anisotropy interposed therebetween. The variation of the voltage difference between the field generating electrodes, i.e., the variation in the strength of an electric field generated by the electrodes changes the transmittance of the light passing through the LCD, and thus desired images are obtained by controlling the voltage difference between the electrodes. A typical LCD includes thin film transistors (TFTs) as switching elements for controlling the voltages to be applied to the pixel electrodes, and a plurality of display signal lines for transmitting signals to be applied to the TFTs.

The LCD has been currently applied for notebook computers, and extending its usage for desktop computers. Contemporary computer users have desires of watching moving pictures on a computer display device under the advanced multimedia environment. In order to satisfy such desires, it is required to enhance the color characteristic and the response time of the LCD.

Accurate color capture (ACC) is a known technique for enhancing the color characteristic.

An LCD receives red, green and blue (RGB) data from an external graphic source. The RGB data represent values of data voltages to be applied to the corresponding pixels of the LCD. The bit number of the RGB data relates to the number of grays of the data voltages. The N bit RGB data can represent $2^N$ grays, and thus the number of the grays is limited by the bit number of the input RGB data. Therefore, the bit number of the input RGB data should be increased for increasing the number of the grays. However, the increase of the bit number of the input RGB data makes the system complicated and the frequency of the system clock increased.

The ACC technique is capable of increasing the number of the grays without increasing the bit number of the input RGB data. For example, a frame rate control (FRC) is used for displaying grays between two arbitrary gray.

The FRC expands one frame into several frames. For instance, a pixel of an LCD can display the gray of '118.5' between the two adjacent grays of '118' and '119' by displaying '119' in a frame and displaying '118' in the next frame. After all, the grays of '118' and '119' displayed in two sequential frames are time-averaged to be seen as the gray of '118.5'. The number of the frames required for FRC depends upon the number of divisions between the two grays.

Dynamic capacitance capture (DCC) is a known technique for enhancing the response time of the LCD.

The DCC compares an image data in a previous frame and an image data in a current frame for a given pixel and modifies the current data such that the difference between the modified current data and the previous data is larger than that between the original current data and the previous data.

When a voltage is applied to a given pixel, a reasonable time is consumed for the liquid crystal molecules to fully respond thereto. However, the time period given to the pixel may be too short for the liquid crystal molecules to fully respond to the applied voltage since the time period for one frame is nearly fixed at about 16.7 msec. The DCC enhances the response time of the liquid crystal molecules. For example, when the image data in the previous frame is '118' and the original image data in the current frame is '128,' the modified current data has a value greater than '128' such as '135'.

The DCC requires a frame memory for storing the data in the previous frame. The modification factors may be stored in a lookup table as function of the previous data and the current data. The size of the lookup table depends on the bit number of the two data to be compared with and increases as the bit number is increased. Therefore, the bit number of the data stored in the frame memory is usually smaller than the bit number of the input RGB data.

SUMMARY OF THE INVENTION

A liquid crystal display is provided, which includes: a liquid crystal panel assembly including a plurality of pixels connected to a plurality of gate lines and a plurality of data lines; a signal controller for processing image data, the signal controller including a dynamic capacitance capture ("DCC") block for modifying image data assigned to the pixels by selectively performing DCC on the image data based on the difference between the image data of a current frame ("current data") and the image data of a previous frame ("previous data"); a gate driver for sequentially applying a gate-on voltage to the gate lines of the liquid crystal panel assembly; and a data driver selecting data voltages among a plurality of gray voltages in response to the modified image data from the signal controller and applies the data voltages to the data lines of the liquid crystal panel assembly.

It is preferable that the DCC block performs the DCC when the difference between the current data and the previous data is larger than a predetermined value, and does not perform the DCC when the difference between the current data and the previous data is equal to or smaller than the predetermined value.

The image data includes upper bits and lower bits and the DCC block performs the DCC preferably based on the upper bits of the current data and of the previous data. The DCC block selectively performs the DCC based on the difference between the upper bits of the current data and of the previous data. The DCC block performs the DCC when the difference between the upper bits of the current data and of the previous data is not one.

According to an embodiment of the present invention, the DCC block includes: a frame memory storing the image data of one frame; a lookup table generating an output based on predetermined bits of the current data and the predetermined bits of the previous data from the frame memory; a pre-processing unit comparing the current data and the previous data and determining application of the DCC; and a DCC modifier selectively generating the modified image data based on the outputs of the lookup table and the lower bits of the current data in response to output of the pre-processing unit.

Preferably, the predetermined bits of the image data are substantially equal to the upper bits of the image data, the output of the lookup table includes a DCC compensation data, and the DCC modifier synthesizes the DCC compensation data and the lower bits of the current data to generate the modified image data.

Alternatively, the predetermined bits of the image data are selected from the upper bits of the image data, the output of the lookup table includes a reference data and a coefficient for the current data, and the DCC modifier obtains a DCC compensation data based on the reference data and the coefficient and synthesizes the DCC compensation data and the lower bits of the current data to generate the modified image data.

According to an embodiment of the present invention, the frame memory stores the upper bits of the image data, and the pre-processing unit includes: an upper bit selector selecting the upper bits of the current data; a larger value selector selecting larger one of the upper bits of the previous data from the frame memory and the upper bits of the current data from the upper bit selector; a smaller value selector selecting smaller one of the upper bits of the previous data from the frame memory and the upper bits of the current data from the upper bit selector; a subtracter subtracting the output of the smaller value selector from the output of the larger value selector; and a DCC control signal generator generating a DCC disable signal having a value depending on the output of the subtracter to be provided for the DCC modifier.

According to another embodiment of the present invention, the preprocessing unit includes: a larger value selector selecting larger one of the previous data from the frame memory and the current data; a smaller value selector selecting smaller one of the previous data from the frame memory and the current data; a subtracter subtracting the output of the smaller value selector from the output of the larger value selector; and a DCC control signal generator generating a DCC disable signal having a value depending on the output of the subtracter to be provided for the DCC modifier.

The DCC disable signal may have a first value if the output of the subtracter is one and may have a second value if not, and, preferably, the DCC modifier generates and outputs the modified image data when the DCC disable signal has the first value and outputs the image data as it is when the DCC disable signal has the second value.

It is preferable that the signal controller further includes an accurate color capture ("ACC") block for converting the image data to have an intermediate value between first and second value and representing the intermediate gray by frequency of the first and the second grays in a predetermined number of frames.

The ACC block preferably includes: a bit number enlarger converting the image data to have an increased bit number; and a bit number reducer reducing the bit number of the converted image data from the bit number enlarger by taking a predetermined upper bits of the converted image data and transforming remaining lower bits of the converted data into frequency of a first data with a first value of the taken upper bits and a second data with the first value plus one during the predetermined number of frames.

A method of driving a liquid crystal display including a plurality of pixels sequentially displaying images based on image data frame by frame is provided, which includes: generating a dynamic capacitance capture ("DCC") value based on an image data of a current frame ("current data") and an image data of a previous data ("previous data"); obtaining difference between the current data and the previous data; selectively modifying the current data based on the DCC value depending on the obtained difference between the current data and the previous data; and applying analog voltages to the pixels in response to the modified current data.

The DCC value generation preferably includes: storing first predetermined bits of the previous data; selecting second predetermined bits of the current data, the second predetermined bits having a bit number smaller than the first predetermined bits; and generating the DCC value based on the second predetermined bits of the current data and of the previous data.

The obtainment of the difference preferably includes: selecting larger one of the first predetermined bits of the previous data and the first predetermined bits of the current data; selecting smaller one of the first predetermined bits of the previous data and the first predetermined bits of the current data; and subtracting the smaller one from the larger one.

The first predetermined bits may be substantially equal to the second predetermined bits. The modification is performed when the obtained difference between the current data and the previous data is one and the modification is not performed otherwise.

The first predetermined bits may include all bits.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

Figure 1:
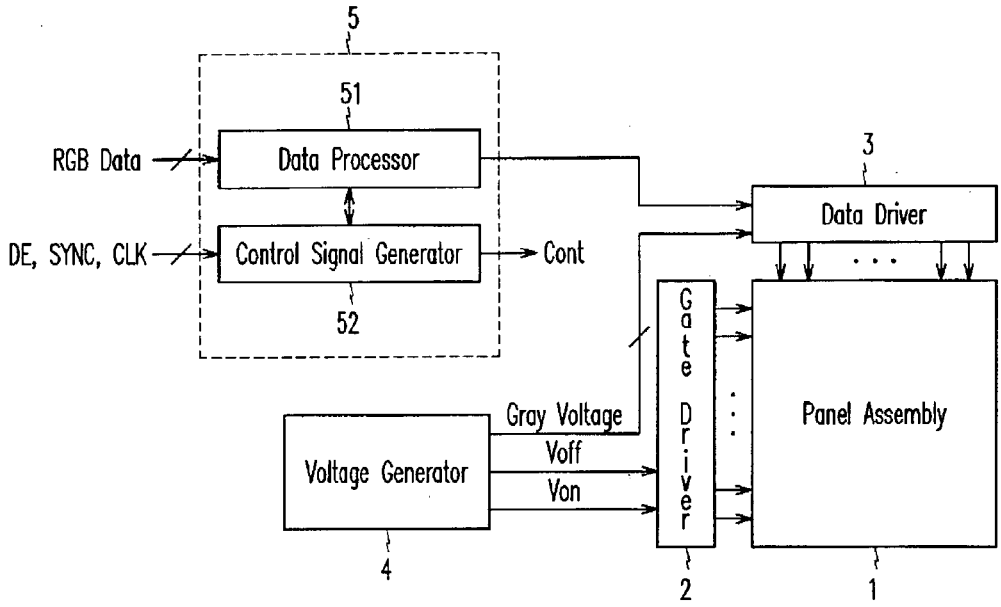
FIG. 1 is a block diagram of an LCD according to an embodiment of the present invention.

The present invention now will be described more fully hereinafter with reference to the accompanying drawings, in which preferred embodiments of the inventions invention are shown.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Now, LCDs and driving methods thereof according to embodiments of this invention will be described in detail with reference to the accompanying drawings.

Figure 2:
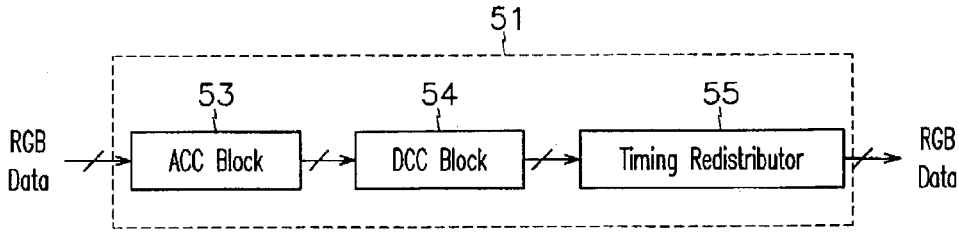
FIG. 2 is a block diagram of an exemplary data processor shown in FIG. 1.
Figure 3:
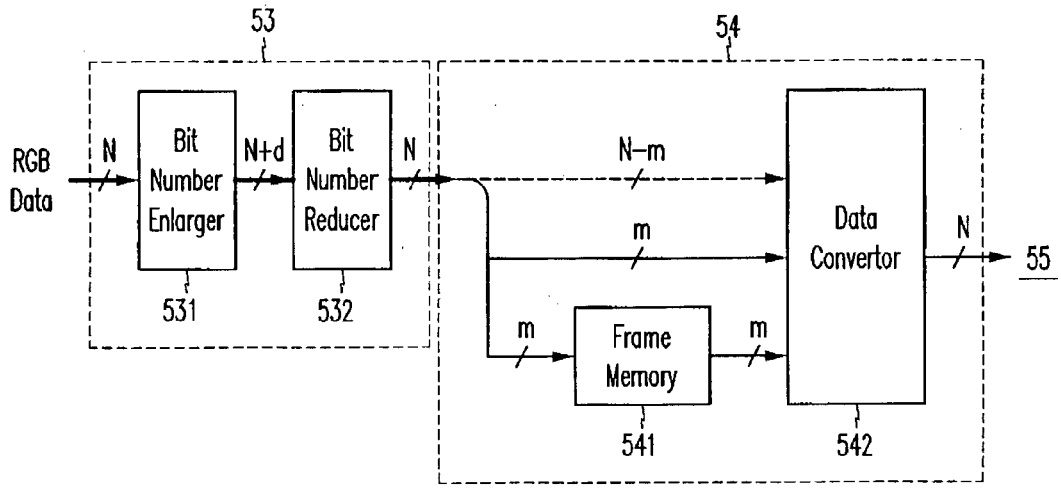
FIG. 3 is a block diagram of an exemplary ACC block and an exemplary DCC block shown in FIG. 2.

FIG. 1 is a block diagram of an LCD according to an embodiment of the present invention, FIG. 2 is a block diagram of an exemplary data processor shown in FIG. 1, and FIG. 3 is a block diagram of an exemplary ACC block and an exemplary DCC block shown in FIG. 2.

As shown in FIG. 1, an LCD includes a liquid crystal panel assembly 1, a gate driver 2, a data driver 3, a voltage generator 4, and a signal controller 5 including a data processor 51 and a control signal generator 52.

The liquid crystal panel assembly 1 has a plurality of gate lines, a plurality of data lines intersecting the gate lines, and a plurality of pixels connected to the gate lines and the data lines. Whenever the gate lines are sequentially scanned, analog voltages for displaying an image are applied to the relevant pixels via the data lines.

The voltage generator 4 generates a gate-on voltage Von and a gate-off voltage Voff for scanning the gate lines to be provided for the gate driver 2. At the same time, the voltage generator 4 generates a plurality of gray voltages to be supplied for the data driver 3.

The signal controller 5 receives RGB data, a data enable signal DE indicating valid data, a synchronization signal SYNC, and a clock signal CLK from an external graphic source. The data processor 51 processes the RGB data to be transmitted to the data driver 3. The RGB data are converted into data voltages selected from the gray voltages by the data driver 3 and supplied to the liquid crystal panel assembly 1. The control signal generator 52 generates various control signals for controlling the display operations based on the data enable signal DE, the synchronization signal SYNC and the clock signal CLK to be transmitted to the respective components.

As shown in FIG. 2, a data processor 51 includes an ACC block 53, a DCC block 54, and a timing redistributor 55. The timing redistributor 55 transforms the RGB data from the graphic source suitable for the data driver 3, which is the primary function of the signal controller 5.

As shown in FIG. 3, an ACC block 53 includes a bit number enlarger 531, and a bit number reducer 532, and a DCC block 54 includes a frame memory 541 and a data converter 542.

The bit number enlarger 531 converts the input N-bit RGB image data such that the bit number of the RGB data is increased by a predetermined value (d), and the bit number reducer 532 reduces the bit number of the converted data from the bit number enlarger 531 to its original value by taking upper N bits of the converted data and transforming the remaining lower bits (d) of the converted data into the number of occurrences of the value of the taken upper N-bit data and the value plus one during a predetermined number of frames. The predetermined number of frames is determined based on the predetermined bit number (d) of the added bits in the bit number enlarger 531. When the value of the taken N-bit data is assumed to be 'A', the frequency of occurrence of 'A' and 'A+1' during the predetermined number of frames is determined by the value of the remaining lower bit data of the modified data. The bit number of the modified data taken by the bit number reducer 532 is not limited to its original value, but depends upon the data processing capability of the data driver 3.

The N-bit data from the bit number reducer 532 are transmitted to the DCC block 54, and the upper m bits of the N-bit data are stored into the frame memory 541, which stores data of one frame.

The data converter 542 receives the m-bit data of the previous frame stored in the frame memory 541 and the N-bit data of the current frame from the bit number reducer 532. The data converter 542 finds a DCC compensation value from a lookup table corresponding to the current data and the previous data. Thereafter, the data converter 542 estimates or calculates the DCC compensation value and the (N−m)-bit data of the input data to obtain a final result.

Figure 4:
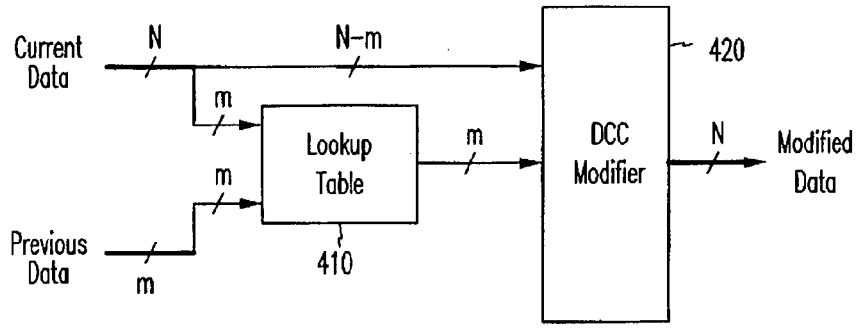
FIGS. 4–6 are block diagrams of exemplary data converters shown in FIG. 3 according to embodiments of the present invention.
Figure 5:
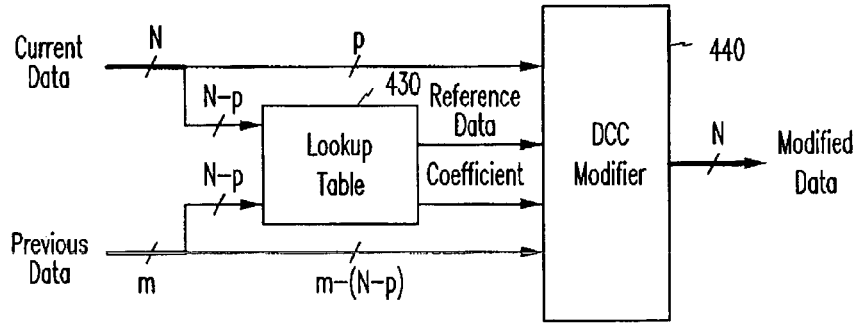
Figures 6, 7:
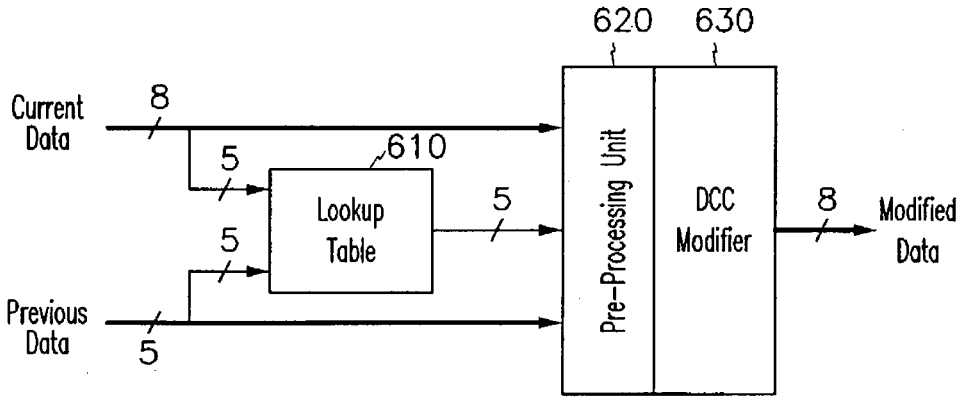
FIG. 7 illustrates an exemplary lookup table shown in FIGS. 4–6.
Figure 8:
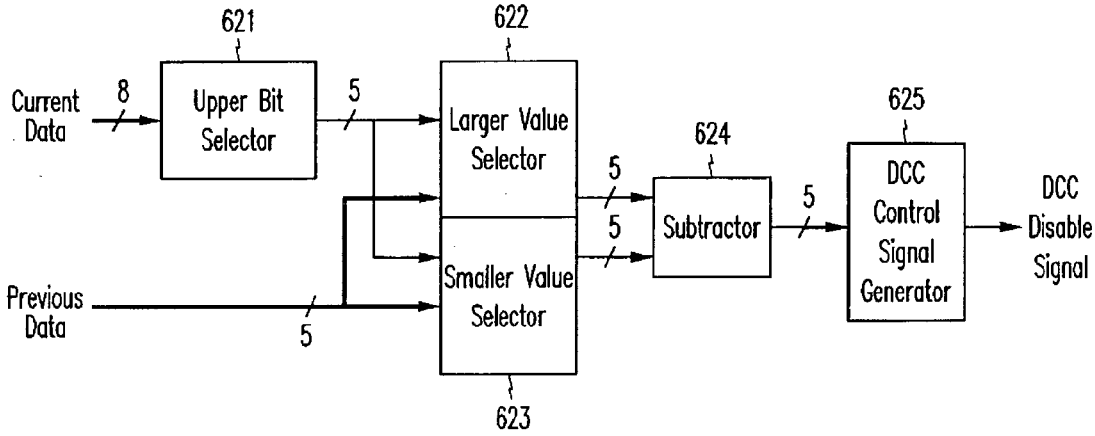
FIG. 8 is a block diagram of an exemplary pre-processing unit shown in FIG. 6 according to an embodiment of the present invention.

FIGS. 4–6 are block diagrams of exemplary data converters shown in FIG. 3 according to embodiments of the present invention, and FIG. 8 illustrates an exemplary lookup table shown in FIG. 4–6.

Referring to FIG. 4, the data converter 542 includes a lookup table 410 and a DCC modifier 420.

The lookup table 410 receives the m-bit previous data from the frame memory 541 shown in FIG. 3 and the upper m-bit data of the N-bit current data from the bit number reducer 532 shown in FIG. 3. An example of lookup table 410 is shown in FIG. 7. An m-bit DCC compensation data is found by the lookup table 410 for the previous data and the current data and provided for the DCC modifier 420. The DCC modifier 420 calculates the m-bit DCC compensation data from the lookup table 410 and the (N−m)-bit current data to obtain a DCC modified N-bit data.

A data converter 542 shown in FIG. 5 also includes a lookup table 430 and a DCC modifier 440.

The lookup table 430 receives an (N−p)-bit data of the N-bit current data and an (N−p)-bit data of the m-bit previous data, where (N−p) is smaller than m. The lookup table 430 outputs a reference data and a relevant coefficient. The DCC modifier 440 generates a DCC-modified N-bit data based on the p bits of the current data and the m-(N−p) bits of the previous data as well as the reference data and the coefficient from the lookup table 430.

As shown in FIG. 6, a data converter according to another embodiment of the present invention includes a lookup table 610, a pre-processing unit 620, and a DCC modifier 630. FIG. 6 shows a case that N=8 and m=5, but the scope of the present invention is not limited thereto.

The lookup table 610 receives an upper m-bit data of an N-bit current data and an m-bit previous data and outputs an-m-bit DCC compensation data corresponding thereto.

The pre-processing unit 620 receives the N-bit current data and the m-bit previous data, and extracts the upper m-bit data from the current data. The pre-processing unit 620 compares the extracted m-bit current data with the m-bit previous data and determines whether the DCC is applied to or not based on the comparison result. For example, if the difference between the extracted m-bit current data and the m-bit previous data is equal to '1', the pre-processing unit 620 determines not to apply the DCC to the current data.

The DCC modifier 630 outputs the current data without modification when the output of the pre-processing unit 620 indicates no application of the DCC. Otherwise, the DCC modifier 630 synthesizes the lower bits of current data and the outputs of the lookup table 610 to generate a DCC modified data.

FIG. 8 is a block diagram of an exemplary pre-processing unit shown in FIG. 6.

As shown in FIG. 8, a pre-processing unit 620 includes an upper bit selector 621, a larger value selector 622, a smaller value selector 623, a subtracter 624, and a DCC control signal generator 625.

The upper bit selector 621 selects upper five bits from the eight bits of a current data. The upper five bits of the current data and a previous data are input into both the larger value selector 622 and the smaller value selector 623. The larger value selector 622 selects the larger one of the two input values, and the smaller value selector 623 selects the smaller one of the two input values. The subtracter 624 calculates the difference between the outputs of the larger value selector 622 and the smaller value selector 623. The DCC control signal generator 625 generates a DCC disable signal having a value determined by the output of the subtracter 624. The DCC disable signal becomes 'high' to disable the DCC modifier 630 when the output of the subtracter 624 is '1.'

This embodiment improves the disadvantage due to the amplification of the difference between the current data and the previous data by the DCC.

Generally, the DCC do not modify the current data having the same upper bits as the previous data as shown in FIG. 7. However, the DCC modifies the current data even when the difference between the upper bits of the current data and the upper bits of the previous data is one. In particular, there can be a case that although the difference between the current data and the previous data is one, the difference between the upper m bits of the current data and the upper m bits of the previous data is also one. Since the DCC modifies the current data such that the difference between the current data and the previous data is amplified, the modified current data may become much larger than the original current data and the previous data. In addition, the ACC may change the current data even for a still image. That is, the current data having the same value as the previous data may become to have a larger value than its original value due to the ACC and the larger value may have larger upper bits than the original value. This may result in a poor image such as a still image with stripes.

Referring to FIG. 7, an example for N=8 and m=5 that a current data is '24=00011000' and a previous data is '23=00010111' is illustrated. In FIG. 7, the column headers represent previous data while the row headers represent current data. The numbers in parentheses represents upper five bits of the data.

Even though the difference between the current data and the previous data is only one, the upper five bits of the current data and the previous data are '00011=3' and '00010=2', respectively, which are also different. From FIG. 7, the obtained DCC compensation data is '32=00100000'. The modified data is the combination of the upper five bits of '32=00100000' and the lower three bits of the current data, i.e., '32=00100000', which is very large compared with its original value '24=00011000'. However, since the difference between the upper five bits of the current data and the previous data is one, the DCC modifier 630 outputs the original current data as it is.

Accordingly, the screen defect due to the DCC and/or the ACC can be removed.

Figure 9:
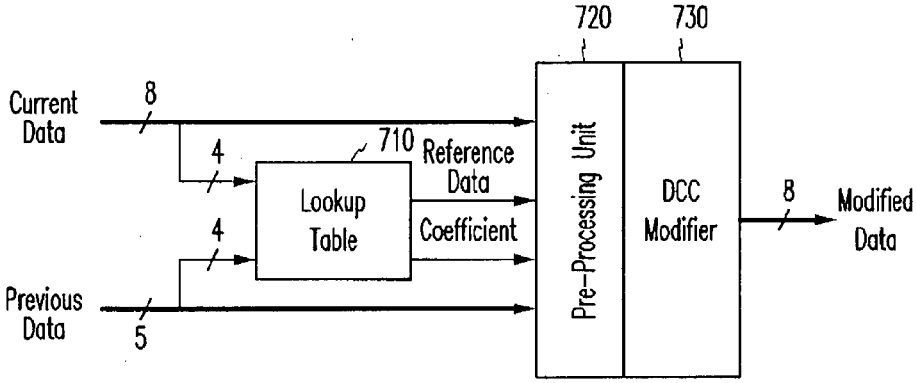
FIG. 9 is a block diagram of an exemplary data converter according to another embodiment of the present invention.

FIG. 9 is a block diagram of an exemplary data converter according to another embodiment of the present invention.

As shown in FIG. 9, a data converter includes a lookup table 710, a preprocessing unit 720, and a DCC modifier 730.

The lookup table 710 receives four bits of the current data and the previous data, which has smaller bit number compared with an example shown in FIG. 6. The lookup table 710 supplies a reference data and a coefficient unlike that shown in FIG. 6, which provides a DCC compensation data. A DCC compensation data is obtained by the operation of the DCC modifier 730 based on the reference data and the coefficient and combined with the lower bits of the current data to form a modified current data.

The pre-processing unit 720 according to this embodiment, like that shown in FIG. 6, compares the predetermined upper bits of the current data and of the previous data and determines the application of the DCC based on the difference between the two values.

Figure 10:
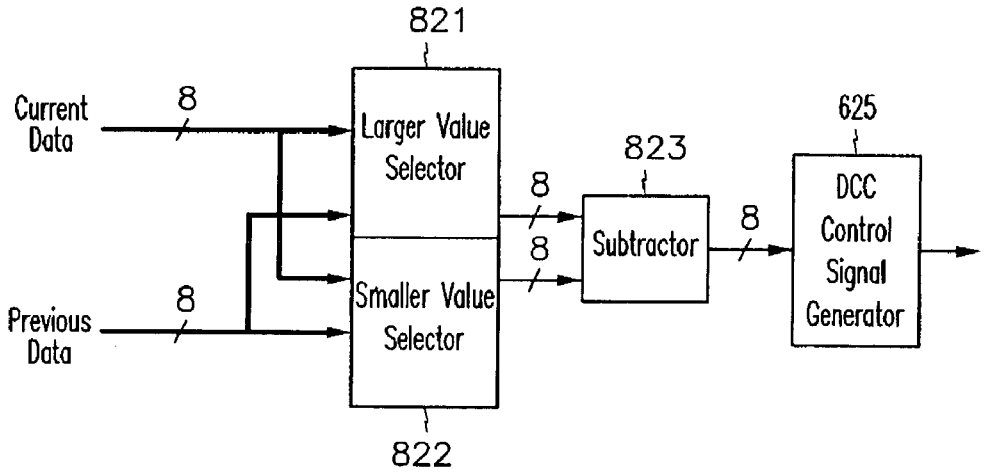
FIG. 10 is a block diagram of an exemplary pre-processing unit shown in FIG. 9.

FIG. 10 is a block diagram of an exemplary pre-processing unit shown in FIG. 9 according to another embodiment of the present invention.

Referring to FIG. 10, a pre-processing unit includes a larger value selector 821, a smaller value selector 822, a subtracter 823, and a DCC control signal generator 824.

The larger value selector 821 and the smaller value selector 822 receive all bits of a current data and of a previous data. It is noted that this embodiment requires a frame memory storing all bits of the previous data. The subtracter 823 calculates the difference between the current data and the previous data as a whole. The DCC control signal generator 824 generates a DCC disable signal having a value determined by the output of the subtracter 624. The DCC disable signal becomes 'high' to disable the DCC modifier 630 when the output of the subtracter 624 is equal to less than a predetermined value. Since the predetermined value can be set within the lower bits of the data, the DCC is performed on the wider range of the input data, thereby obtaining excellent picture quality while increasing the amount of calculation compared with the previous embodiments.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display comprising:

a liquid crystal panel assembly including a plurality of pixels connected to a plurality of gate lines and a plurality of data lines;

a signal controller for processing image data, the signal controller including an accurate color capture("ACC") block and a dynamic capacitance capture ("DCC") block;

a gate driver for sequentially applying a gate-on voltage to the gate lines of the liquid crystal panel assembly; and a data driver selecting data voltages among a plurality of gray voltages in response to the modified image data from the signal controller and applies the data voltages to the data lines of the liquid crystal panel assembly, wherein the ACC block comprises a bit number enlarger converting the image data to have an increased bit number; and a bit number reducer reducing the bit number of the converted image data from the bit number enlarger by taking a predetermined upper bits of the converted image data and transforming remaining lower bits of the converted image data into frequency of a first data with a first value of the taken upper bits and a second data with the first value plus one during the predetermined number of frames; and wherein the DCC block modifies the first image data assigned to the pixels by selectively performing DCC on the first image data based on the difference between the image data of a current frame ("current data") and the image data of a previous frame ("previous data").

2. The liquid crystal display of claim 1, wherein the DCC block performs the DCC when the difference between the current data and the previous data is larger than a predetermined value, and does not perform the DCC when the difference between the current data and the previous data is equal to or smaller than the predetermined value.

3. The liquid crystal display of claim 1, wherein the first image data comprises upper bits and lower bits and the DCC block performs the DCC based on the upper bits of the current data and of the previous data.

4. The liquid crystal display of claim 3, wherein the DCC block selectively performs the DCC based on the difference between the upper bits of the current data and of the previous data.

5. The liquid crystal display of claim 4, wherein the DCC block performs the DCC when the difference between the upper bits of the current data and of the previous data is not one.

6. The liquid crystal display of claim 3, wherein the DCC block comprises:

a frame memory storing the first image data of one frame;

a lookup table generating an output based on predetermined bits of the current data and the predetermined bits of the previous data from the flame memory;

a pre-processing unit comparing the current data and the previous data and determining application of the DCC; and a DCC modifier selectively generating the modified image data based on the outputs of the lookup table and the lower bits of the current data in response to output of the pre-processing unit.

7. The liquid crystal display of claim 6, wherein the predetermined bits of the first image data are substantially equal to the upper bits of the first image data, the output of the lookup table includes a DCC compensation data, and the DCC modifier synthesizes the DCC compensation data and the lower bits of the current data to generate the modified image data.

8. The liquid crystal display of claim 6, wherein the frame memory stores the upper bits of the first image data, and the pro-processing unit comprises:

an upper bit selector selecting the upper bits of the current data;

a larger value selector selecting larger one of the upper bits of the previous data from the frame memory and the upper bits of the current data from the upper bit selector;

a smaller value selector selecting smaller one of the upper bits of the previous data from the frame memory and the upper bits of the current data from the upper bit selector;

a subtracter subtracting the output of the smaller value selector from the output of the larger value selector; and a DCC control signal generator generating a DCC disable signal having a value depending on the output of the subtracter to be provided for the DCC modifier.

9. The liquid crystal display of claim 8, wherein the DCC disable signal has a first value if the output of the subtracter is one and has a second value if not, and the DCC modifier generates and outputs the modified image data when the DCC disable signal has the first value and outputs the image data as it is when the DCC disable signal has the second value.

10. The liquid crystal display of claim 6, wherein the pre-processing unit comprises:

a larger value selector selecting larger one of to previous data from the frame memory and the current data;

a smaller value selector selecting smaller one of the previous data from the frame memory and the current data;

a subtracter subtracting the output of the smaller value selector from the output of the larger value selector; and a DCC control signal generator generating a DCC disable signal having a value depending on the output of the subtracter to be provided for the DCC modifier.

11. The liquid crystal display of claim 10, wherein the DCC disable signal has a first value if the output of the subtracter is one and has a second value if not, and the DCC modifier generates and outputs the modified image data when the DCC disable signal has the first value and outputs the first image data as it is when the DCC disable signal has the second value.

12. A liquid crystal display comprising:

a liquid crystal panel assembly including a plurality of pixels connected to a plurality of gate lines and a plurality of data lines;

a signal controller for processing image data, the signal controller comprising an accurate color capture ("ACC") block and a dynamic capacitance capture ("DCC") block;

a gate driver for sequentially applying a gate-on voltage to the gate lines of the liquid crystal panel assembly; and a data driver selecting data voltages among a plurality of gray voltages in response to the modified image data from the signal controller and applies the data voltages to the data lines of the liquid crystal assembly, wherein the ACC block converts the image data to first image data having an average value between first and second values, and the first image data comprises upper bits and lower bits and the DCC block performs the DCC based on the upper bits of the current data and of the previous data; and the DCC block modifies the first image data assigned to the pixels by selectively performing DCC on the first image data based on the difference between the image data of a current frame ("current data") and the image data of a previous frame ("previous data"), and wherein the DCC block comprises:

a frame memory storing the first image data of one frame;

a lookup table generating an output based on predetermined bits of the current data and the predetermined bits of the previous data from the frame memory;

a preprocessing unit comparing the current data and the previous data and determining application of the DCC;

and a DCC modifier selectively generating the modified image data based on the outputs of the lookup table and the lower bits of the current data in response to output of the pre-processing unit; and wherein the predetermined bits of the image data are selected from the upper bits of the first image data, the output of the lookup table includes a reference data and a coefficient for the current data, and the DCC modifier obtains a DCC compensation data based on the reference data and the coefficient and synthesizes the DCC compensation data and the lower bits of the current data to generate the modified image data.

13. A method of driving a liquid crystal display including a plurality of pixels sequentially displaying images based on image data frame by frame, the method comprising:

generating an accurate color capture ("ACC") value of an image data having an intermediate value between first and second value and representing the intermediate gray by using a bit number enlarger to convert the image data to have an increased bit number and a bit number reducer to reduce the bit number of the converted image data from the bit number enlarger by taking a predetermined upper bits of the converted image data and transforming remaining lower bits of the converted image data into frequency of a first data with a first value of the taken upper bits and a second data with the first value plus one during the predetermined number of frames;

generating a dynamic capacitance capture ("DCC") value based on the ACC value of a current frame ("current data") and the ACC value of a previous data ("previous data");

calculating difference between the current data and the previous data;

selectively modifying to current data based on the DCC value depending on the calculated difference between the current data and the previous data; and applying analog voltages to the pixels in response to the modified current data.

14. The method of claim 13, wherein the DCC value generation comprises:

storing first predetermined bits of the previous data;

selecting second predetermined bits of the current data, the second predetermined bits having a bit number equal to or smaller than the first predetermined bits; and generating the DCC value based on the second predetermined bits of the current data and the first predetermined bits of the previous data.

15. The method of claim 14, wherein the calculation of the difference comprises:

selecting larger one of the first predetermined bits of the previous data and the second predetermined bits of the current data;

selecting smaller one of the first predetermined bits of the previous data and the second predetermined bits of the current data; and subtracting the smaller one from the larger one.

16. The method of claim 15, wherein the first predetermined bits are substantially equal to the second predetermined bits.

17. The method of claim 16, wherein the modification is performed when the calculated difference between the current data and the previous data is one and the modification is not performed otherwise.

18. The method of claim 15, wherein the first predetermined bits and the second predetermined bits include all bits.

* * * * *